US006371902B1

(12) United States Patent
Bluemle

(10) Patent No.: US 6,371,902 B1
(45) Date of Patent: Apr. 16, 2002

(54) METHOD AND APPARATUS FOR FORMING SCORE LINES ON PRE-CUT ENVELOPE BLANKS

(75) Inventor: Martin Bluemle, Horhausen (DE)

(73) Assignee: Winkler & Duennebier Maschinenfabrik und Eisengiesserei GmbH, Neuwied (DE)

( * ) Notice: Subject to any disclaimer, the term of this patent is extended or adjusted under 35 U.S.C. 154(b) by 0 days.

(21) Appl. No.: 09/472,075

(22) Filed: Dec. 23, 1999

Related U.S. Application Data

(63) Continuation-in-part of application No. 08/940,863, filed on Sep. 30, 1997, now abandoned.

(30) Foreign Application Priority Data

Sep. 30, 1996 (DE) ..... 196 40 042

(51) Int. Cl.[7] ..... B31F 1/00

(52) U.S. Cl. ..... 493/422; 493/401; 493/402; 493/370

(58) Field of Search ..... 493/422, 401, 493/402, 403, 400, 396, 241, 355, 370, 425

(56) References Cited

U.S. PATENT DOCUMENTS

| | | | | |
|---|---|---|---|---|
| 3,640,522 A | | 2/1972 | Oelmann et al. | |
| 3,731,600 A | | 5/1973 | Earp | |
| 3,880,056 A | | 4/1975 | Dohnalik | |
| 4,159,823 A | * | 7/1979 | Bryer et al. | 270/21 |
| 4,260,146 A | | 4/1981 | Mitzel | |
| 4,427,405 A | | 1/1984 | Hoshi | |
| 4,521,209 A | * | 6/1985 | DuFresne | 493/432 |
| 4,642,150 A | | 2/1987 | Stemmler | |
| 4,671,152 A | | 6/1987 | Blümle | |
| 4,714,394 A | | 12/1987 | Ehlscheid et al. | |
| 4,823,659 A | | 4/1989 | Falasconi | |
| 5,062,825 A | * | 11/1991 | Smith et al. | 493/194 |
| 5,109,741 A | | 5/1992 | Fuchs | |
| 5,147,273 A | * | 9/1992 | Rottmann et al. | 493/349 |
| 5,232,428 A | * | 8/1993 | Jambor | 493/177 |
| 5,389,188 A | | 2/1995 | Hicks | |
| 5,554,093 A | | 9/1996 | Porchia et al. | |
| 6,024,685 A | * | 2/2000 | Kirsch | 493/396 |

FOREIGN PATENT DOCUMENTS

| | | |
|---|---|---|
| DE | 648075 | 7/1937 |
| DE | 1196058 | 7/1965 |
| DE | 1229827 | 12/1966 |
| DE | 2029977 | 12/1971 |
| DE | 2752411 | 8/1980 |
| DE | 3406264 | 10/1984 |
| DE | 4329834 | 2/1995 |
| GB | 284259 | 1/1927 |

* cited by examiner

*Primary Examiner*—Rinaldi I. Rada
*Assistant Examiner*—Sam Tawfik
(74) *Attorney, Agent, or Firm*—W. F. Fasse; W. G. Fasse

(57) ABSTRACT

An apparatus for forming a score line in a pre-cut blank, such as an envelope blank (3), includes a scoring blade roller (6) and a counter roller (7), wherein a portion of the circumferential surface of the scoring blade roller (6) is provided with a suction shell (12) having a plurality of suction openings (13) therein. The suction openings are connected together in respective groups that may be individually and selectively connected to a vacuum or suction air source. In this manner, a leading edge portion (72) of the blank (3) can be taken up, held, and rotationally pulled by the scoring blade roller (6), while a tail portion (70, 71) of the blank (3) downstream of the score lines (2) or the scoring blades (33, 34) is not fixedly held on the scoring blade roller (6), but rather is only loosely held and guided along. A method of forming score lines in a blank avoids tearing, deforming or shifting the blank out of registration at the time of forming the score lines, by pulling the blank (3) in the transport direction by its leading edge, while leaving the tail end portion (70, 71) of the blank (3) downstream from the intended location of the score line (2) loose, so that it can freely move as necessary to carry out compensation movements while the score line is being formed.

41 Claims, 5 Drawing Sheets

9
3
11
72
71
8
3
51
34
70
12
15
13
R
21
6
33
7
61
60
A
62
3
11
4
1
10

METHOD AND APPARATUS FOR FORMING SCORE LINES ON PRE-CUT ENVELOPE BLANKS

CROSS-REFERENCE TO RELATED APPLICATION

This application is a Continuation-In-Part of copending prior U.S. application Ser. No. 08/940,863 filed on Sep. 30, 1997 now abandoned the entire disclosure of which is incorporated herein by reference.

PRIORITY CLAIM

The present application is based on and claims the priority of German Patent Application 196 40 042.2, that was filed on Sep. 30, 1996. The entire disclosure of the German Priority Application 196 40 042.2 is incorporated herein by reference.

FIELD OF THE INVENTION

The invention relates to a method and apparatus for forming crosswise score lines which facilitate later folding along such score lines, on pre-cut sheet goods blanks, and especially pre-cut envelope blanks, using at least one scoring roller and one counter roller.

BACKGROUND INFORMATION

It is generally known to form one or more score lines on a pre-cut sheet goods blank, in order to facilitate the subsequent folding of the blank along these score lines. Such a score line does not involve the folding or pleating of the blank, but rather merely weakens the material of the blank along this score line so that the blank can be subsequently folded, easily, sharply and precisely along the provided score line. To this end, the score line may involve a compression or reduction of the thickness of the blank material along the score line, or may involve a rupturing or weakening of at least some of the fibers of the blank material along the score line, or may involve a perforation of the blank material along the score line.

The formation of one or more crosswise score lines on an envelope blank or on a blank for a shipping bag or the like is generally subject to particular problems and difficulties if the material of the blank is non-elastic to a great extent, for the following reasons. Typically, in order to form a score line, a scoring knife or blade is used to push the material of the blank into a groove or recess provided in a counter tool such as a counter roller. If the material of the blank, such as paper for example, is not sufficiently elastic, then the scoring knife or blade will try to push the paper material into the groove or recess of the counter tool, but the paper is not well suited to allow this to occur. Namely, the non-elastic paper will be either stretched or torn during the scoring operation, or, if the paper does not yield, then the position and alignment of the pre-cut blank will be shifted or offset relative to the cycling of the machine. For this reason, the normally rigid and non-elastic blank is typically held and guided in specific, complicated ways using specific complicated means, which becomes evident in the finished product.

For letter envelopes, it is usually necessary to provide two crosswise score lines on the corresponding pre-cut blank, spaced apart from one another at a spacing distance corresponding to the height of the finished letter envelope. These two score lines are typically each produced respectively in a quick impact-stroke manner. Any inaccuracies arising in this context must be manually corrected after shutting off the machine by appropriate corrective adjustments on the scoring blade roller. To achieve this, and to remove any other interferences or defect-producing errors, the scoring blade roller is typically mounted in a tiltable or pivotable manner on the machine frame. In this context it is further typical to provide complicated bridge and frame constructions for supporting the tiltable and usually driven scoring blade roller. After the removal or correction of any such errors or inaccuracies, it is quite time consuming or complicated to again engage the drive wheel of the scoring blade roller in the drive line of the machine in a proper and exactly registered manner in order to restart the operation of the machine. Substantial problems also arise in the unguided output of blanks out of the apparatus, and especially for blanks having lateral points, peaks, or corners.

It has also been especially difficult to properly feed thin flexible blank materials such as paper envelope blanks. Conventional scoring machines feed and advance the material in a flat plane between the scoring roller and the counter roller by pushing the material along a flat table. Such a pushing feed advance is provided by pushing the blank from its trailing edge using pusher dogs, drive chains or the like, or by pinching and pushing the blank in the nip formed between two feed rollers, for example. While such a feed may be adequate for relatively stiff cardboard and the like, it has been found in practice to be unsuitable for flexible materials such as paper. Namely, the flexible blank has a tendency to crumple or shift improperly while it is being pushed, and also has a tendency to curl or deflect out of the intended flat planar feed advance path. Also, regardless of the material, such conventional apparatus and methods suffer problems due to the difficulty of the required synchronization between the flat planar feed advance and the rotational motion of the scoring roller and the counter roller.

SUMMARY OF THE INVENTION

In view of the above it is the aim of the invention to provide an improved method and apparatus for forming score lines on pre-cut sheet blanks, and especially envelope blanks, that avoid or overcome the above described difficulties and disadvantages of the prior art, and achieve further advantages that are apparent from the present description.

The above objects have been achieved in a method for forming score lines on a pre-cut sheet blank using a scoring blade roller and a counter roller according to the invention, wherein the blank is pulled by vacuum applied to its leading edge portion in the transport direction at least during the formation of the crosswise score line, and wherein the rear or tail portion of the blank behind the crosswise score line in the transport direction is only loosely guided along and is not held by vacuum or by other means so that this rear or tail portion of the blank is freely movable, i.e. is not rigidly held, to allow it to undergo compensating movements during the formation of the score line. Moreover, the blank is pulled and transported by the scoring blade roller itself. The pulling vacuum is applied via the scoring blade roller, and the blank partially wraps around the scoring blade roller for proper guidance.

Previously, it has been typical for carrying out the score line formation, that the pre-cut blank was clampingly held on both sides of the scoring blade roller and its counter tool, and a pushing force was applied to the blank essentially at a location behind, in the transport direction, the crosswise score line that was to be formed. Contrary thereto, according to the invention, the blank is now held or engaged in the area of its forward edge or forward margin before the formation of the score line, and then the blank is held and guided along this forward edge or margin during the transport of the blank through the scoring station. The rear or tail end of the blank is no longer held and is therefore freely able to carry out any necessary compensating movements or positional adjustments if the material of the blank must yield toward the blank's forward edge, which continues to be transported exactly in registration, during formation of the crosswise score lines. The inherently disadvantageous material characteristics or properties, for example as are possessed by a rigid and non-elastic paper material, therefore can no longer lead to production difficulties and errors, which makes it possible to increase the piece count output of a production machine as compared to the prior art.

The above mentioned objects have further been achieved in an apparatus for forming crosswise score lines on pre-cut blanks of predominantly non-elastic material, according to the invention, wherein the apparatus includes a machine frame, a drive, at least one scoring blade roller, and a counter roller. Particularly according to the invention, the scoring blade roller comprises a suction shell with a plurality of circumferentially arranged suction openings, which may be connected to a source of vacuum suction.

Preferably the scoring blade roller includes a first scoring blade that is rigidly fixed in position and a second scoring blade that is adjustable to various circumferential positions relative to the first scoring blade. Thereby the second scoring blade may be adjusted to different format sizes of the blanks to be scored, and particularly different spacings between the two score lines to be provided on each blank. Also, the suction for holding the leading edge portion of each blank is provided through the plural suction openings or holes in a suction shell forming a partial circumferential sector-shaped part of the scoring blade roller. The suction shell extends only over a first angular range, e.g. less than 180°, and does not include any scoring blade within this range. On the other hand, the scoring blades are arranged in a second angular range that does not include any suction holes and that extends over an angle complementing the first angular range to form the complete 360° circumference of the scoring blade roller. Preferably there is a single first angular range and a single second angular range that together make up the 360° circumference, but there could be two first angular ranges (with respective suction shells) and two second angular ranges (with respective scoring blades) arranged alternately in succession making up the 360° circumference. Thereby, for example, two successive blanks may be transported and scored during each rotation of the scoring blade roller. The suction shell may be fixed or adjustable relative to the fixed first scoring blade.

According to further details of the invention, the suction openings or holes are grouped together into respective groups that are respectively controllable or actuatable in a selectively targeted manner. In this context it is particularly advantageous if the suction openings on the circumference of the suction shell are grouped together into respective axis-parallel groups that are respectively connectable in a row-by-row manner to a suction conduit or line, in order to be able to adapt the particular suction configuration to various formats of the blank. Particularly, a single row or a group of e.g. two or three rows of the suction openings can be selected and actuated with suction. The particular row or group of rows selected depends on the format size of the blanks to be scored. Namely, the appropriate row or rows of suction openings will be selected to correspond to the location of the forward leading edge margin of the blank on the scoring roller or particularly on the suction shell, and to establish the proper spacing between the leading edge of the blank and the location at which the fixed first scoring blade is to form the first score line. Thus, a proper selection of which row or rows of the suction openings to be actuated with suction can partially or entirely replace the need for making the suction shell physically circumferentially adjustable with respect to the scoring roller shaft and the fixed first scoring roller. The number of rows selected in a group will, for example, relate to the amount of suction holding power that needs to be applied to the leading edge margin portion of the blank, which in turn depends on the format size of the blank. The single row or group of rows that is selected will be constantly supplied with a suction vacuum as that row or group rotates around the axis of the scoring roller, at least over the rotation angle in which the leading edge portion is to be held by vacuum against the scoring roller.

In order to controllably actuate and deactuate the suction openings, the suction shell comprises a plurality of suction channels extending parallel to the axis of the scoring blade roller. Furthermore, each axis-parallel suction channel is connectable in a freely selectable manner to a main vacuum channel that is arranged extending axially in the drive shaft of the scoring blade roller. In order to achieve this, in addition to a typical suction air control head at one end of the drive shaft, the present apparatus further includes a suction air selector ring arranged preferably in the middle of the scoring blade roller. This suction air selector ring on the one hand has a radial bored hole arranged in the drive shaft and leading to the main vacuum channel, and on the other hand has an internal circumferential groove and a radial bored hole leading to the suction channels in the suction shell. By means of these structural features of the apparatus, the above described method according to the invention may be carried out.

BRIEF DESCRIPTION OF THE DRAWINGS

In order that the invention may be clearly understood, it will now be described in connection with an example embodiment, with reference to the drawings, wherein.

DETAILED DESCRIPTION OF PREFERRED EXAMPLE EMBODIMENTS AND OF THE BEST MODE OF THE INVENTION

Figure 8:
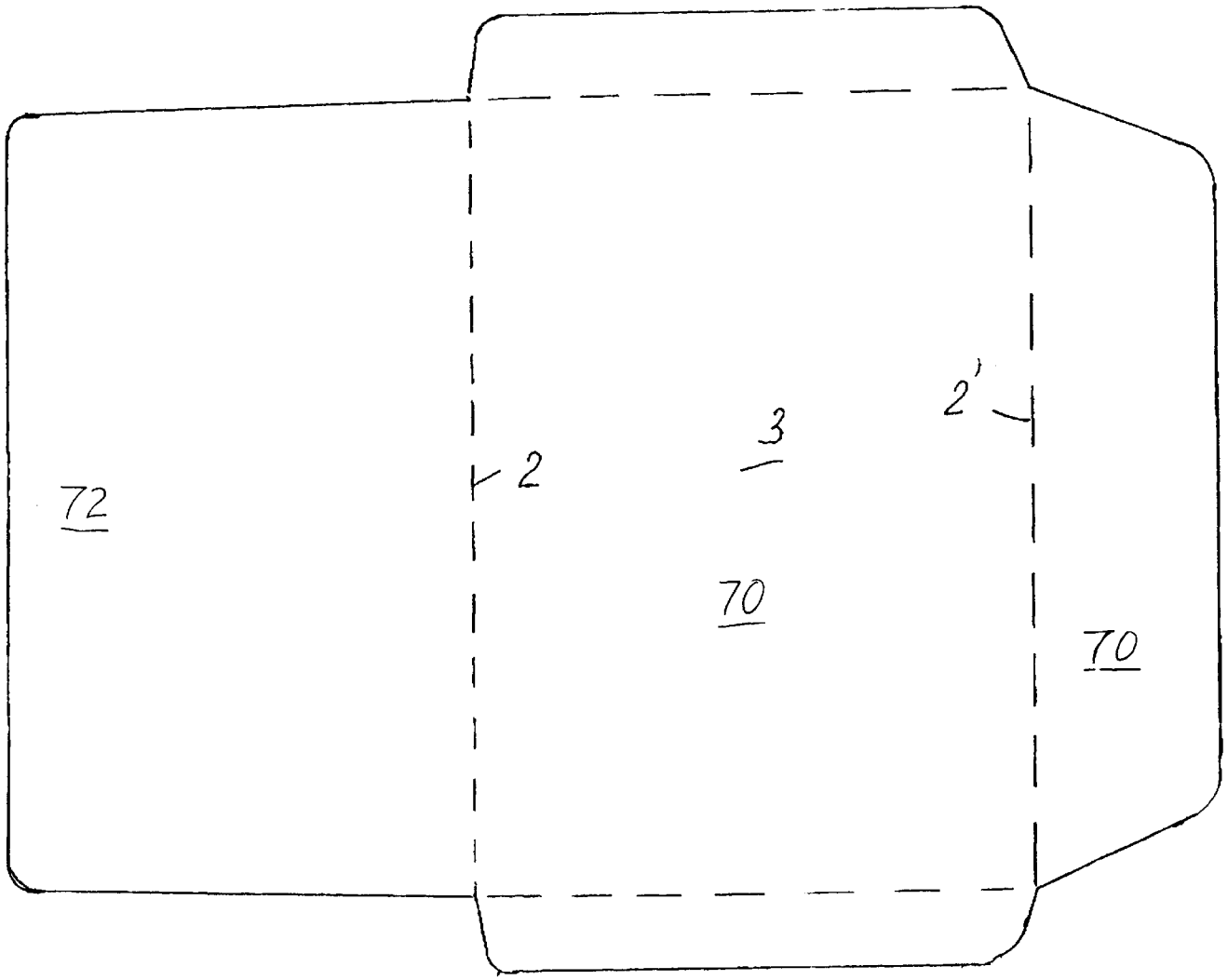
FIG. 8 is a schematic plan view of an envelope blank showing two score lines formed thereon.

An embodiment of an apparatus 1 for producing one or more crosswise score lines 2 and 2', on a sheet goods blank 3, such as an envelope blank (see FIG. 3 and FIG. 8), comprises a machine frame 4 (see FIGS. 1 and 2), and at least one drive 5 for a scoring blade or scoring blade roller 6, which cooperates with a counter tool, especially in the form of a counter roller 7 having an elastic material outer layer or surface covering on a cylindrical roller body. The scoring blade roller 6 is rotatably supported in the machine frame 4 by means of a drive shaft 8. Furthermore, a first idler roller 9 that transports the blank 3 to the scoring blade roller 6 and a second idler roller 10 that further transports the blank 3 away from the scoring blade roller 6 are arranged on the machine frame 4 to cooperate with the scoring blade roller 6. The idler rollers 9 and 10 are each provided with suction holding devices 11 in any arrangement that is generally known, for suction-holding the leading edge of each envelope blank 3 and thereby pulling the blank 3 to transport it.

The suction blade roller 6 comprises a suction shell 12 that has a plurality of suction holes or openings 13 provided on the outer circumference thereof. These suction openings 13 are collected or grouped together into respective groups or clusters, which are actuatable, i.e. which may have vacuum applied thereto, in a group-wise targeted manner. Thus, the proper ones of the vacuum actuatable suction openings 13 may be actuated to adapt the suction pattern, i.e. the particular row or rows that are suction-actuated, to the particular format size of a respective blank 3 that is to be processed.

In the example embodiment shown in the drawings, the suction openings 13 in the suction shell 12 are grouped together into respective groups extending along lines parallel to the axis of the scoring blade roller 6. These respective axis-parallel groups are correspondingly selectably connectable in a row-by-row manner to a suction conduit or line 14. In order to achieve this, the suction shell 12 comprises a plurality of axis-parallel suction channels 15 to which the circumferentially arranged suction openings 13 are directly radially outwardly connected. Furthermore, a main vacuum channel 16 is provided within the drive shaft 8 of the scoring blade roller 6, and may be connected to each one of the axis-parallel suction channels 15.

Figure 2:
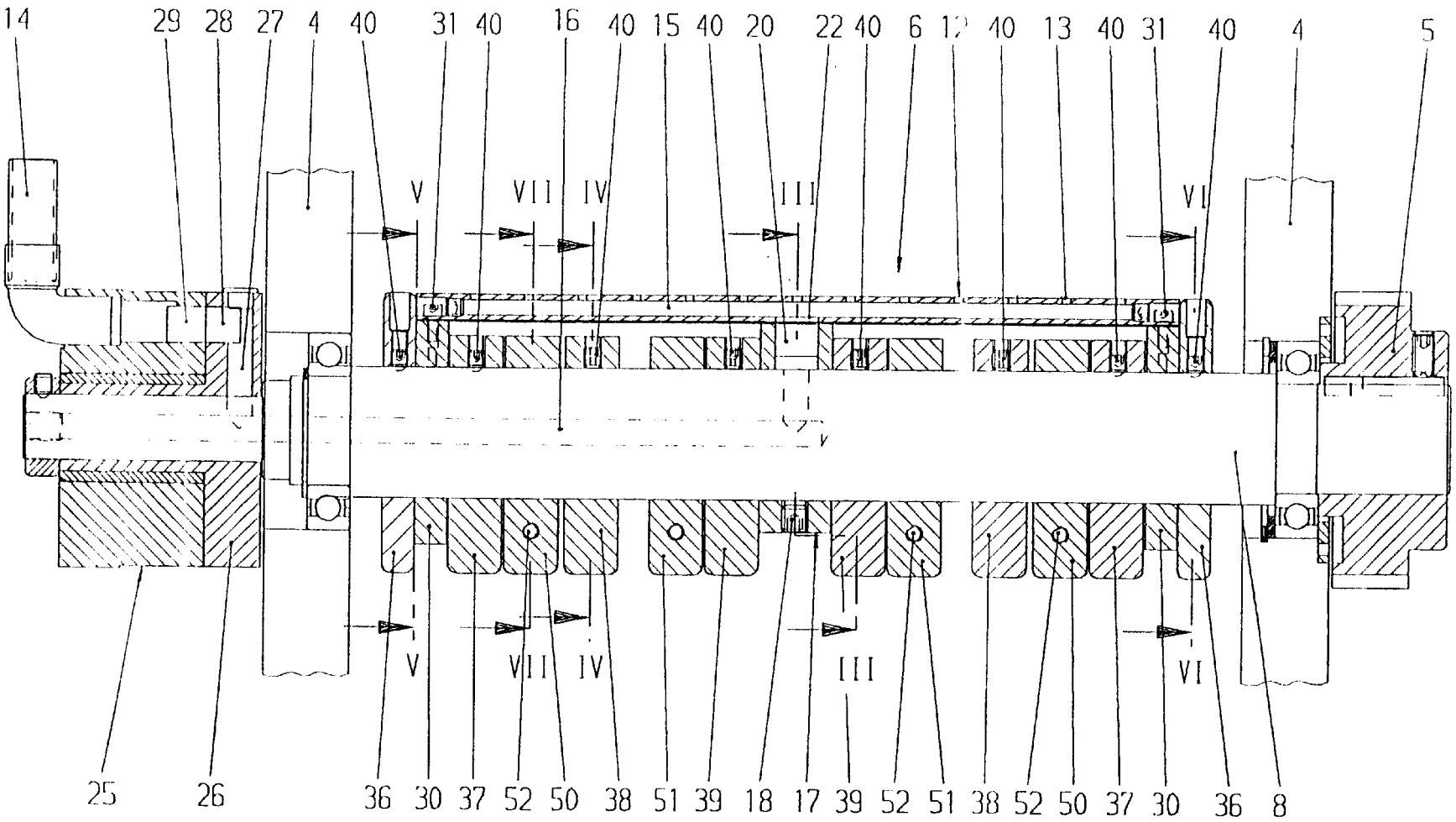
FIG. 2 is a lengthwise sectional view through the scoring blade roller of the apparatus shown in FIG. 1.

In order to achieve this, a suction air selector ring 17 is provided, for example in this embodiment the suction air selector ring 17 is fixed approximately in the middle of the scoring blade roller 6 as shown in FIG. 2, for example by means of a screw 18. The suction air selector ring 17 allows the vacuum or suction air flow to be coupled to the individual suction channels 15 in a targeted manner as respectively selected. To achieve this, the suction air selector ring 17 comprises an internal circumferential groove or plenum space 19 over a portion of its circumference, and a radial bored hole 20 passing radially outwardly from the internal circumferential groove 19. The radial bored hole 20 is respectively allocated to the suction channels 15 in the suction shell 12. In other words, the radial hole 20 can be selectively positioned to communicate a vacuum suction with any selected one of the suction channels 15, and thus the corresponding row of the suction openings 13, as follows.

Figure 3:
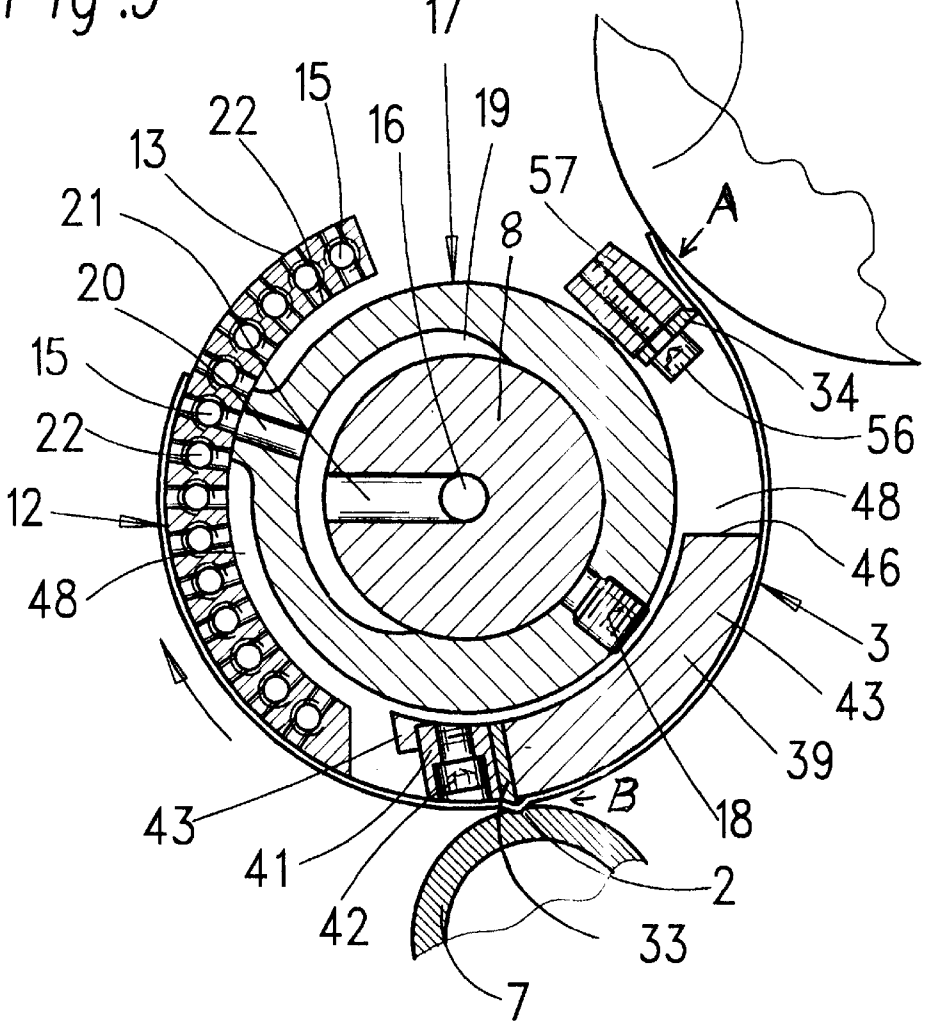
FIG. 3 is a sectional view taken along the section line III—III in FIG. 2, but with the suction air selector ring adjusted to a different circumferential position than in FIG. 1.
Figure 7:
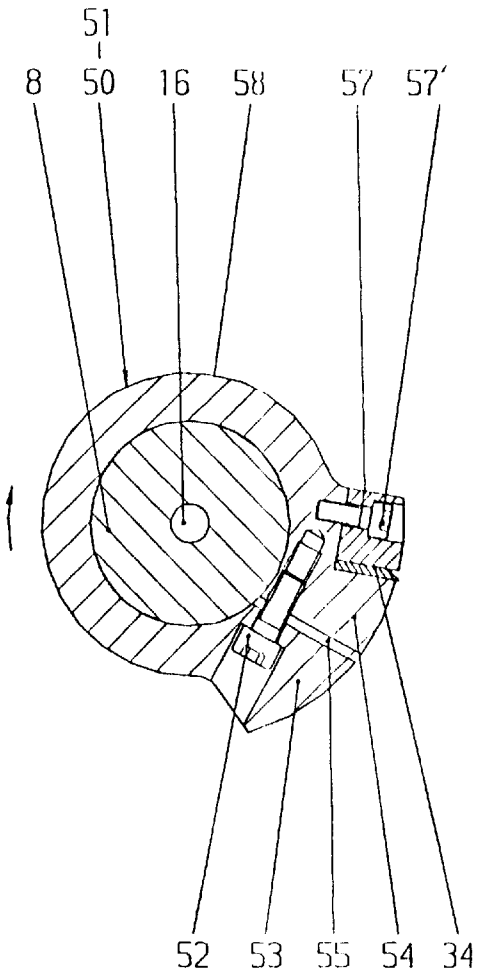
FIG. 7 is a sectional view taken along the section line VII—VII in FIG. 2.

By repositioning or adjusting the adjustable suction air selector ring 17, it is possible to connect any or each selected one of the suction channels 15 shown in FIG. 3 to the vacuum that prevails in the main vacuum channel 16, whereby in the present example embodiment, an additional radial bored hole 21 leads from the main vacuum channel 16 to the internal circumferential groove or plenum space 19. The position, form, dimensions, and configuration of the internal circumferential groove 19 are selected so that each suction channel 15 in the suction shell 12 is reachable, i.e. connectable by the radial bored hole 20, by rotationally adjusting the selector ring 17 relative to the shaft 8. Thus, the plenum space or circumferential groove 19 must extend over an angular range corresponding to the angular range of the suction openings 13 or suction channels 15, in this embodiment.

Just as the suction shell 12 comprises suction openings 13 directed radially outwardly from each suction channel 15, a radially inwardly directed connection opening 22 is provided extending radially inwardly from each suction channel 15 to communicate selectively with the radial bored hole 20 in the suction air selector ring 17. The connection openings 22 of all the suction channels 15 that are not connected to the radial bored hole 20 of the suction air selector ring 17 at any particular time, i.e. in any particular suction selection configuration, are connected to atmospheric pressure to ensure that atmospheric pressure will also prevail in the non-selected suction channels 15 themselves and their corresponding suction openings 13. To provide suction to more than one row of suction openings 13 simultaneously, the radial bored hole 20 may be wide enough to overlap two adjacent connection openings 22, or can be replaced with e.g. two radial bored holes that respectively communicate with two adjacent openings 22. Alternatively, each opening 22 can supply e.g. two channels 15, or each channel 15 can supply two rows of openings 13.

The supply of or creation of the required negative pressure or vacuum in the main vacuum channel 16 in the drive shaft 8 can be achieved in any known manner, but here specifically is achieved using a suction air control head 25. The drive shaft 8 and its internal main vacuum channel 16 extend into the control head 25, where a control disk 26 is mounted on the drive shaft 8 in a rotationally fixed manner. The control disk 26 comprises a radially directed bored hole 27 and an axially directed window 28 in communication with the bored hole 27. In a position facing the window 28, the control head 25 similarly comprises a window 29, to which a suction conduit 14 is connected. The window 29 arranged on an end face of the control head 25 and facing the control disk 26 extends in an arcuate shape matched to that of the window 28. Thereby, a suction or vacuum pressure condition prevailing in the suction conduit 14 is communicated into the main vacuum channel 16 during a rotational range in which the windows 28 and 29 overlap. Correspondingly the vacuum is also provided via the selector ring 17 into a selected one of the suction channels 15 during the above mentioned rotational range. Thus, vacuum suction is continuously applied to a single selected row or group of suction openings 13 as the scoring blade roller rotates through that rotational range, so that a pre-cut blank 3 will be held to the roller 6 by suction provided by the respective selected suction channel 15, and will thus be transported, from the position at which the blank 3 is taken over from the first idler roller 9 until the position at which the blank 3 is given over to the second idler roller 10. In the embodiment shown in FIG. 1, this is the case over an angular range of slightly more than 180°, whereby the axis of the scoring blade roller 6 lies in a plane lower than the axis of the second further-transporting idler roller 10, but generally this angular range should be at least about 90°. The axis of the first idler roller 9 lies somewhat higher than that of the second idler roller 10. In this manner, the scoring blade roller 6 itself also holds, pulls, transports and guides the blank 3 while carrying out the scoring process. Thereby also, the blank is wrapped or curved partly circumferentially around the scoring blade roller 6 as it is transported thereby (see FIGS. 1 and 3). Note that the blank 3 is thus pulled by its leading edge portion while the tail end thereof is not held or pushed, but instead is somewhat loose to allow shifting readjustment thereof.

Figure 5:
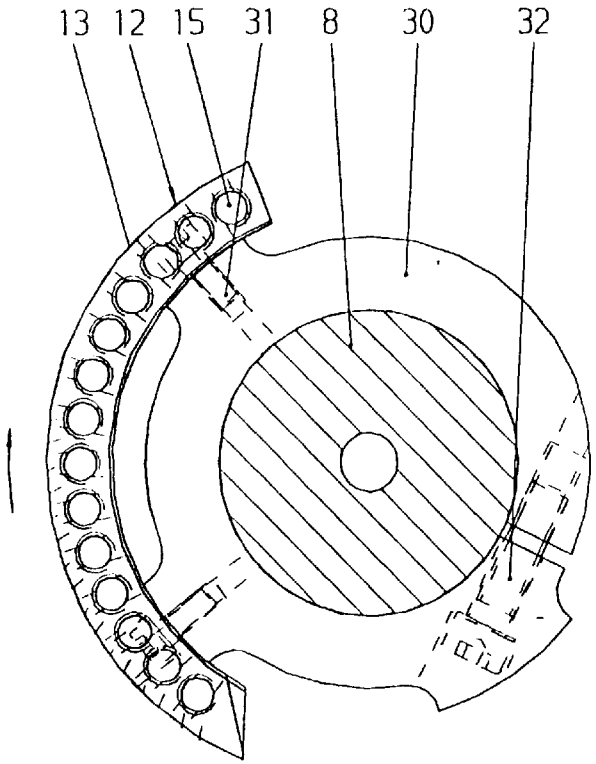
FIG. 5 is a partial sectional end view taken along the section line V—V in FIG. 2.

The mounting or attachment of the suction shell 12 and its bearing support on the drive shaft 8 is achieved by means of support rings 30, which are arranged toward axially outer ends as shown in FIG. 2. The suction channel 12 is secured by screws 31 to the circumference of the support rings 30. In an advantageous embodiment, the support rings 30 are split as shown in FIG. 5, so that they are easily adjustable in position on the drive shaft 8, whereupon a clamping screw 32 provided in each support ring 30 can then be tightened to secure or clamp the ring 30 onto the drive shaft 8 in a force locking manner.

In order to form the score lines 2, in this example embodiment, two scoring knives or blades 33 and 34 are arranged respectively on the circumference of the scoring blade roller 6 outside of or displaced circumferentially away from the suction shell 12 as especially shown in FIG. 3. Thus, the suction shell 12 also only extends over a portion of the circumference of the scoring blade roller 6, and particularly in this example embodiment extends over a first angular range of about 120°. The scoring knives 33 and 34 are arranged in the other portion or other two thirds of the circumference of the scoring blade roller 6, i.e. in a second angular range of about 240° in this embodiment. The suction shell 12 and particularly the suction openings thereof may generally extend of the first angular range being from 20° to 180°, more particularly 40° to 150°, even more particularly 90° to 140°, or especially 110° to 130°. The first angular range does not include any scoring blades. Instead, the scoring blades 33 and 34 are arranged only in the second angular range, which does not include any suction openings. Moreover, there are no suction holes provided within ±20°, preferably ±30°, or more preferably ±40° from either one of the scoring blades 33 and 34. For this reason, the suction shell 12 is not loaded or impacted by any forces arising from the scoring knives 33 and 34. Also, the paper of the blank 3 in the vicinity of each blade 33, 34 is not tightly held, so it is free to undergo positional readjustment as necessary as the scoring process is being carried out. The first scoring knife 33 is fixedly and non-adjustably mounted on the scoring blade roller 6. On the other hand, the second scoring knife 34 is mounted on the scoring blade roller 6 so as to be adjustable in the circumferential direction relative to the first scoring knife 33.

Figure 4:
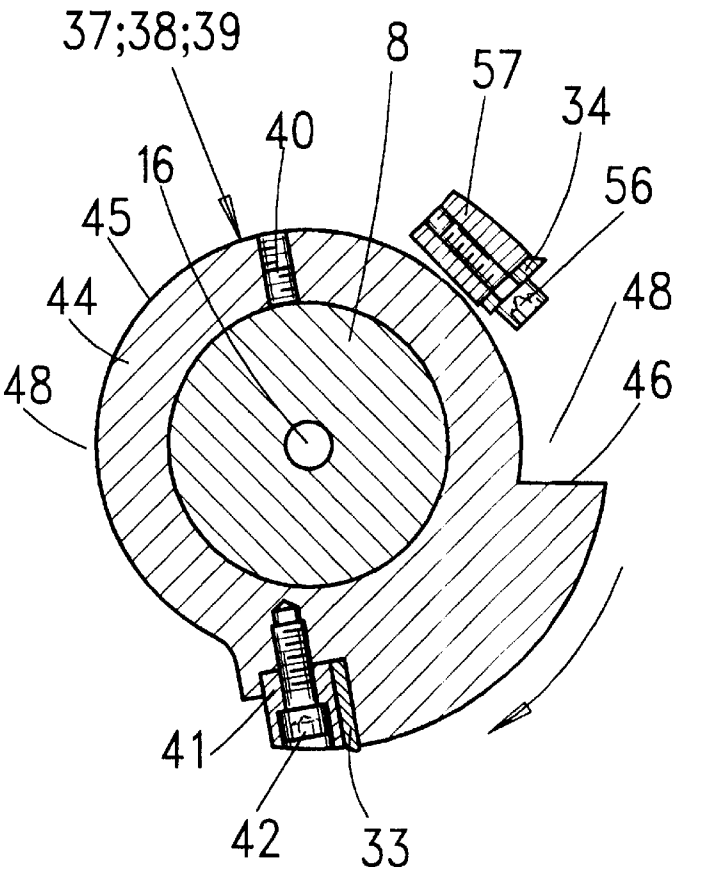
FIG. 4 is a sectional view taken along the section line IV—IV in FIG. 2.
Figure 6:
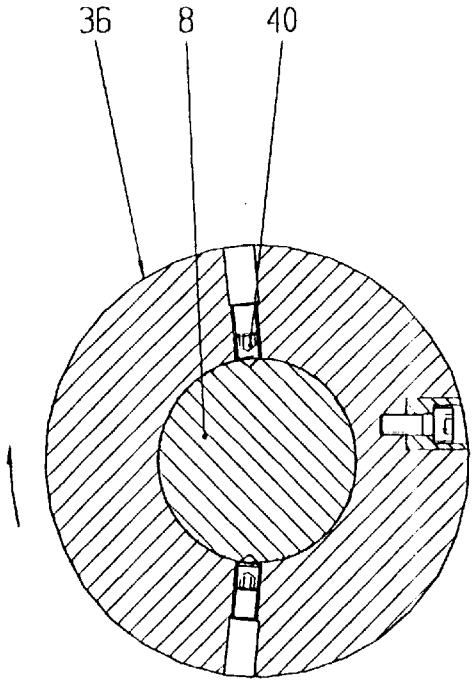
FIG. 6 is a sectional view taken along the section line VI—VI in FIG. 2.

Various support rings 36, 37, 38 and 39 serve as carriers for the rigidly mounted first scoring knife 33. These rings 36 to 39 are arranged mirror-symmetrically to the suction air selector ring 17 at relative spaces from one another on the drive shaft 8, where they are then fixed in axial and circumferential directions by means of screws 40. The two axially outer support rings 36 as shown in FIG. 6 have a circular circumferential rim, and simultaneously serve as a drive for the counter-roller 7. On the other hand, the other support rings 37, 38 and 39 have substantially the same cross-sectional configuration as the support ring 38 shown in FIG. 4, namely with an outer contour that deviates from a complete circular shape. Only the first scoring knife or blade 33, which is not adjustable in the circumferential direction of the scoring blade roller 6, is secured by means of a clamping rail 41 and a securing screw 42 to a projection 43 that has a wing-shaped or circular dove-tail shaped cross-section and a circular outer contour. This projection 43 extends over an arc of about 90°.

The remaining portion 44 of the support ring 38 and the support rings 37 and 39 respectively have a circular cylindrical outer contour 45, which transitions gradually through the clamping rail 41 into the outer contour 47 of the projection 43 at one end thereof, and transitions abruptly in a right-angle or radially projecting step 46 at the other end thereof. The ring-shaped part 44 of the support rings 38, 37 and 39 has a smaller outer diameter, to the extent of the radial height of the step 46, as compared to the outer contour 47 of the projection 43. This smaller diameter of the ring-shaped part 44 provides a free space 48 in which the second adjustable scoring knife 34 may be adjustably arranged. Furthermore, the suction shell 12 is also located in this free space 48, as can be seen in FIG. 3.

The adjustable second scoring knife 34 is mounted on the drive shaft 8 by means of support rings 50 and 51, which are similarly arranged spaced from one another in a mirror-symmetrical fashion relative to the suction air selector ring 17 on the drive shaft 8. The support rings 50 and 51 are split like the support rings 30, and may be secured to the drive shaft 8 by means of a clamping screw 52 after they have been adjusted as needed in the circumferential direction. Over the major portion of the circumference of the support rings 50 and 51, these support rings 50 and 51 have the same outer diameter as do the support rings 37, 38 and 39, while this is also true for the radial projections 53 and 54 projecting from the support rings 50 and 51 on both sides of the split or slot 55. The second scoring knife 34 may be mounted or secured to the projection 54 by a clamping rail 57 that is secured by a screw 57'. From the seat of the clamping rail 57, the projection 54 falls off directly to the smaller outer diameter 58 of the support ring 50 or 51. Once the second scoring knife 34 has been adjusted to its proper rotational position, dependent on the location of the intended score line on the blank, then this knife is fixedly secured. During operation, both knives 33 and 34 remain rigidly fixed relative to the shaft 8.

Figure 1:
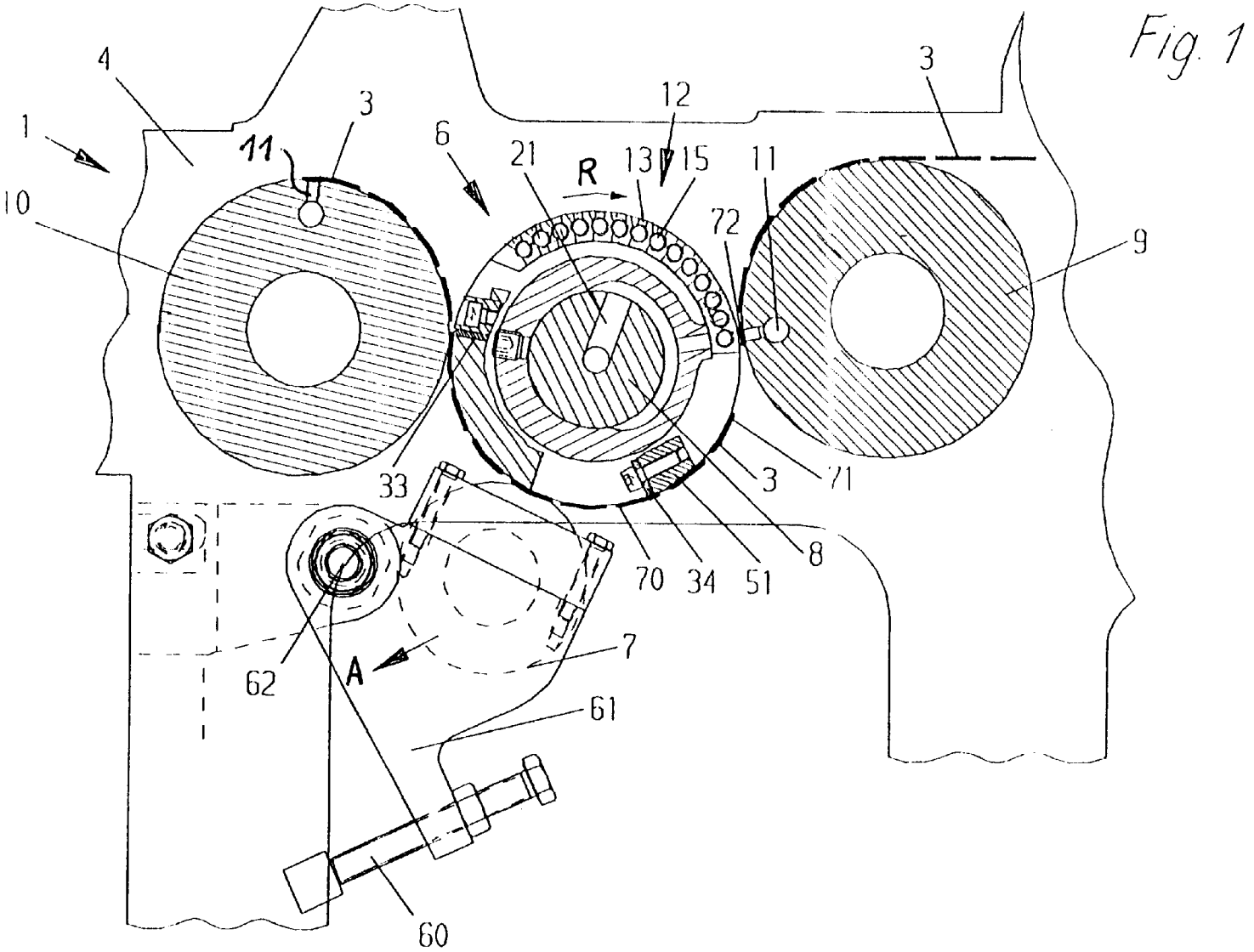
FIG. 1 is a schematic partial sectional view of the essential components of the apparatus for forming score lines according to the invention.

While the scoring blade roller 6, as shown in FIGS. 1 and 2, is rotatably and drivably supported relative to the machine frame 4, the counter roller 7 on the one hand may be positionally fixed relative to the scoring blade roller 6 as shown in FIG. 1, and on the other hand the counter roller 7 may be tilted away from the scoring blade roller 6. Moreover, the counter roller 7 is tiltably adjustable relative to the machine frame and relative to the scoring blade roller 6, for example by means of a threading 60, e.g. a threaded bolt 60. The counter roller 7 is supported on a bearing block 61, whereby the counter roller 7 and its bearing block 61 together are tiltably supported about a tilting axis 62 on the machine frame 4. When needed, the counter roller 7 can be tilted down away from the scoring blade roller 6 in the direction of the arrow A as shown in FIG. 1.

It is evident from the various figures, that the apparatus 1 is properly suited for carrying out the intended method steps according to the invention. An example embodiment of such a method as carried out on the apparatus 1 will now be described. The pre-cut blank 3 is especially an individual pre-cut envelope blank of thin, flexible, non-elastic, non-stretchable material such as paper, which is to be processed. Note that the blank 3 is not a continuous web of material, and is not a stiff material that would be unable to curve or deflect circumferentially around the scoring blade roller 6.

The blank 3 is taken up by the scoring blade roller 6 from the first idler roller 9 at location A in FIG. 3, by means of suction air applied to the suction openings 13 communicating with a selected one of the suction channels 15 at or along the leading edge of the blank 3. As the scoring blade roller 6 rotates in the direction of arrow R as shown in FIG. 1, the blank 3 is pulled along with the roller 6 by the suction, and a score line 2 is formed in the blank 3 when the fixed scoring knife 33 runs over the counter roller 7, with the pre-cut blank 3 between the knife 33 and the resilient or grooved surface of the counter roller 7 at location B in FIG. 3. The effect of the knife 33 pushing the material of the blank 3 against and into the resilient counter surface is to form the weakened score line 2. The two locations A and B are angularly or circumferentially displaced from each other by a substantial angular range, e.g. at least 90° or even at least 120°. This ensures that the blank is held and transported smoothly and lies well against the scoring blade rollers 6.

The rear or tail portion 70 of the pre-cut blank 3 behind the crosswise score line 2, in the transport direction, is not firmly held to the roller 6 and is not pushed in any manner but is only loosely guided and pulled along with the rest of the blank 3 at the time of forming the score line 2. Thus, the tail portion 70 is able to shift or move or yield as necessary for allowing a compensating movement during the formation of the score line 2. For example, if the scoring knife 33 pulls the material of the blank 3 as it presses into the resilient surface or a groove provided in the counter roller 7, then the tail portion 70 is free to yield to such pulling. This is true also for the trailing edge portion 71 of the pre-cut blank 3 trailing behind downstream from the second adjustable scoring knife 34 for forming the second score line 2'. In this manner, tearing or deforming or misaligning of the blank 3 during formation of the score lines 2 and 2' is avoided.

It should be understood in the view of FIG. 1 that a first pre-cut blank 3 had been picked up by the scoring blade roller 6, but is shown in a position at which the second idler roller 10 has already taken over the leading edge and front portion of the blank 3, while the first score line 2 has already been formed by the first scoring knife 33 and the second score line 2' is still to be formed by the second scoring knife 34. Also in the illustrated state, a second pre-cut blank 3 is just being picked-up by the suction device of the scoring blade roller 6 from the first idler roller 9 at location A. It is also to be understood that each successive pre-cut blank 3 must be taken up and held by means of the vacuum or suction air along the forward edge or margin 72 of the blank 3, whereby the blank 3 is then further transported and also guidingly held onto the scoring blade roller 6 by the vacuum applied only to the forward margin 72, as shown in FIG. 1. In the case of a letter envelope as the pre-cut blank 3, advantageously, the rim or margin 72 of the backside flap of the envelope is taken up and held by the vacuum or suction (see FIG. 8). Such a case can also be achieved by the apparatus 1 shown in the figures and described above, because the suction air pattern or configuration on the circumference of the suction shell 12 can be adjusted as necessary to match any shape of blank 3 that is to be held and transported. It is also clear in FIGS. 1 and 3 that each blank 3 is transported along a curved circumferential transport path around the scoring blade roller 6, and is expressly not transported along a flat plane between the scoring blade roller 6 and the counter roller 7.

Although the invention has been described with reference to specific example embodiments, it will be appreciated that it is intended to cover all modifications and equivalents within the scope of the appended claims. It should further be understood that the present disclosure extends to and includes all possible combinations of any of the features recited in any of the appended claims. All values falling within any range disclosed herein are also part of the invention and may form limitations defining a patentable aspect of the invention.

What is claimed is:

1. An apparatus for forming a score line on a sheet goods blank, comprising:

a machine frame;

a rotation drive;

a drive shaft connected to said rotation drive;

a scoring blade roller that is rotatably supported on said machine frame and mounted on said drive shaft to rotate said scoring blade roller with said drive shaft; and a counter roller that is rotatably supported adjacent to said scoring blade roller and that is mounted on said machine frame so as to be tiltable, adjustable and fixable at a selected adjusted position relative to said scoring blade roller so as to contact and cooperate with said scoring blade roller;

wherein said scoring blade roller includes at least one scoring blade adapted to cooperate with said counter roller to form a score line on a sheet goods blank, and a suction shell that is mounted on said drive shaft and that extends on a first angular portion of a circumference of said scoring blade roller; and wherein said suction shell has a plurality of suction holes in an outer arcuate surface thereof that are adapted to be connected to a suction vacuum so as to suction hold said sheet goods blank onto said suction shell to engage and transport said sheet goods blank on said scoring blade roller.

2. An apparatus for forming a score line on a sheet goods blank, comprising:

a machine frame;

a scoring blade roller rotatably supported on said machine frame;

a counter roller rotatably supported adjacent to said scoring blade roller;

a rotation drive; and a drive shaft connected to said rotation drive, with said scoring blade roller being mounted on said drive shaft to rotate said scoring blade roller;

wherein said scoring blade roller includes at least one scoring blade adapted to cooperate with said counter roller to form a score line on a sheet goods blank, and a suction shell that is mounted on said drive shaft and that extends along a first angular portion of a circumference of said scoring blade roller corresponding to about 120° of said circumference; and wherein said suction shell has a plurality of suction holes in an outer arcuate surface thereof that are adapted to be connected to a suction vacuum so as to suction hold said sheet goods blank onto said suction shell to engage and transport said sheet goods blank on said scoring blade roller.

3. An apparatus for forming a score line on a sheet goods blank, comprising:

a machine frame;

a scoring blade roller rotatably supported on said machine frame;

a counter roller rotatably supported adjacent to said scoring blade roller;

a rotation drive; and a drive shaft connected to said rotation drive, with said scoring blade roller being mounted on said drive shaft to rotate said scoring blade roller;

wherein said scoring blade roller includes a first pair of support rings fixed onto said drive shaft, a second pair of support rings rotationally adjustably clamped onto said drive shaft, a third pair of support rings rotationally adjustably clamped onto said drive shaft, a fixedly mounted first scoring blade and an adjustably mounted second scoring blade that are respectively adapted to cooperate with said counter roller to form respective score lines on a sheet goods blank, and a suction shell that is mounted on said drive shaft and that extends on a first angular portion of a circumference of said scoring blade roller;

wherein said fixedly mounted first scoring blade is secured to said first pair of support rings, said adjustably mounted second scoring blade is secured to said second pair of support rings, and said suction shell is secured to said third pair of support rings;

wherein said first scoring blade is fixedly mounted at a non-adjustable circumferential position relative to said drive shaft, and said second scoring blade is adjustably mounted at an adjustable circumferential position relative to said drive shaft, relative to said non-adjustable circumferential position of said first scoring blade, and relative to said suction shell;

wherein said suction shell has an adjustable circumferential position relative to said drive shaft, relative to said fixedly mounted first scoring blade and relative to said adjustably mounted second scoring blade; and wherein said suction shell has a plurality of suction holes in an outer arcuate surface thereof that are adapted to be connected to a suction vacuum so as to suction hold said sheet goods blank onto said suction shell to engage and transport said sheet goods blank on said scoring blade roller.

4. An apparatus for forming a score line on a sheet goods blank, comprising:

a machine frame;

a scoring blade roller rotatably supported on said machine frame;

a counter roller rotatably supported adjacent to said scoring blade roller;

a rotation drive; and a drive shaft connected to said rotation drive, with said scoring blade roller being mounted on said drive shaft to rotate aid scoring blade roller;

wherein said scoring blade roller includes at least one scoring blade adapted to cooperate with said counter roller to form a score line on a sheet goods blank, and a suction shell that is mounted on said drive shaft and that extends on a first angular portion of a circumference of said scoring blade roller;

wherein said suction shell has a plurality of suction holes in an outer arcuate surface thereof that are adapted to be connected to a suction vacuum so as to suction hold said sheet goods blank onto said suction shell to engage and transport said sheet goods blank on said scoring blade roller; and wherein said first angular portion is in a range from 20° to 180°, said suction shell has an arcuate length extending entirely along said first angular portion, and at least some of said suction holes are angularly displaced from one another by an angle within said range of said first angular portion.

5. The apparatus according to claim 4, wherein said first angular portion is in a range from 90° to 140°.

6. The apparatus according to claim 4, wherein said first angular portion is in a range from 110° to 130°.

7. An apparatus for forming a score line on a sheet goods blank, comprising:

a machine frame;

a scoring blade roller rotatably supported on said machine frame;

a counter roller rotatably supported adjacent to said scoring blade roller;

a rotation drive; and a drive shaft connected to said rotation drive, with said scoring blade roller being mounted on said drive shaft to rotate said scoring blade roller;

wherein said scoring blade roller includes at least one scoring blade adapted to cooperate with said counter roller to form a score line on a sheet goods blank, and a suction shell that is mounted on said drive shaft and that extends on a first angular portion of a circumference of said scoring blade roller;

wherein said suction shell has a plurality of suction holes in an outer arcuate surface thereof that are adapted to be connected to a suction vacuum so as to suction hold said sheet goods blank onto said suction shell to engage and transport said sheet goods blank on said scoring blade roller; and wherein none of said suction holes are located within a clearance angle of at least ±20° from any one of said at least one scoring blade.

8. The apparatus according to claim 7, wherein said clearance angle is at least ±30°.

9. An apparatus for forming a score line on a sheet goods blank, comprising:

a machine frame;

a scoring blade roller rotatably supported on said machine frame;

a counter roller rotatably supported adjacent to said scoring blade roller;

a rotation drive; and a drive shaft connected to said rotation drive, with said scoring blade roller being mounted on said drive shaft to rotate said scoring blade roller;

wherein said scoring blade roller includes at least one scoring blade adapted to cooperate with said counter roller to form a score line on a sheet goods blank, and a suction shell that is mounted on said drive shaft and that extends on a first angular portion of a circumference of said scoring blade roller; and wherein said suction shell has a plurality of suction holes in an outer arcuate surface thereof that are adapted to be connected to a suction vacuum so as to suction hold said sheet goods blank onto said suction shell to engage and transport said sheet goods blank on said scoring blade roller;

wherein said suction holes comprise plural separate groups of said suction holes; and further comprising means for selectively communicating said suction vacuum to only a single selected one of said groups of said suction holes continuously as said single selected one of said groups rotates with said scoring blade roller through a suction-holding rotational angle of at least 120°.

10. A combination of a sheet goods blank comprising an individual pre-cut piece of a flexible non-stretchable material, and an apparatus for forming a score line on said sheet goods blank, comprising:

a machine frame;

a scoring blade roller rotatably supported on said machine frame;

a counter roller rotatably supported adjacent to said scoring blade roller;

a rotation drive; and a drive shaft connected to said rotation drive, with said scoring blade roller being mounted on said drive shaft to rotate said scoring blade roller;

wherein said scoring blade roller includes at least one scoring blade adapted to cooperate with said counter roller to form a score line on said sheet goods blank, and a suction shell that is mounted on said drive shaft and that extends on a first angular portion of a circumference of said scoring blade roller;

wherein said suction shell has a plurality of suction holes in an outer arcuate surface thereof that are adapted to be connected to a suction vacuum so as to suction hold said sheet goods blank onto said suction shell to engage and transport said sheet goods blank on said scoring blade roller;

wherein said blank is curved and lies against a circumferential surface of said scoring blade roller along a circumferential arc of at least 120°; and wherein only a leading edge margin of said blank is held to said suction shell and a body portion of said blank is not held to said scoring blade roller.

11. An apparatus for forming a score line on a sheet goods blank having a leading edge margin portion and a body tail portion, said apparatus comprising:

a machine frame;

a scoring blade roller rotatably supported on said machine frame;

a counter roller rotatably supported adjacent to said scoring blade roller;

a rotation drive; and a drive shaft connected to said rotation drive, with said scoring blade roller being mounted on said drive shaft to rotate said scoring blade roller;

wherein said scoring blade roller includes at least one scoring blade adapted to cooperate with said counter roller to form a score line on the sheet goods blank, and a suction shell that is mounted on said drive shaft and that extends on a first angular portion of a circumference of said scoring blade roller;

wherein said suction shell has plural rows of suction holes in an outer arcuate surface thereof; and further comprising means for controlledly applying a suction vacuum to at least a selected one of said rows of suction holes for suction holding only said leading edge margin portion of said sheet goods blank onto said suction shell and simultaneously leaving said body tail portion of said sheet goods blank freely movable and not held to said scoring blade roller to engage and transport said sheet goods blank on said scoring blade roller only by holding and pulling said leading edge margin portion.

12. The apparatus according to claim 11, wherein said suction shell is adjustably mounted on said drive shaft so as to have an adjustable position in a circumferential direction on said drive shaft.

13. The apparatus according to claim 11, wherein said rows of suction holes are grouped into respective groups of suction holes, and wherein said groups of suction holes are each respectively individually and selectably connectable to said suction vacuum by said means for controlledly applying said suction vacuum.

14. The apparatus according to claim 13, further comprising a vacuum source that provides said suction vacuum, wherein each one of said groups of suction holes respectively consists of a respective single one of said rows of said suction holes extending parallel to a rotation axis of said scoring blade roller, and wherein each said single row of suction holes is respectively individually and selectably row-wise connectable to said vacuum source by said means for controlledly applying said suction vacuum.

15. The apparatus according to claim 11, wherein said means for controlledly applying said suction vacuum include a main vacuum channel provided in said drive shaft, and a plurality of suction channels in said suction shell that respectively extend parallel to an axis of said drive shaft and that are respectively connected to ones of said rows of said suction holes and that are each respectively selectably connectable to said main vacuum channel.

16. The apparatus according to claim 15, wherein said means for controlledly applying said suction vacuum further include an adjustable suction air selector ring having therein a first radial hole connected to and communicating with said main vacuum channel, a second radial hole selectively connected to and communicating with a selected one of said suction channels, and a circumferentially directed internal groove that interconnects and communicates said first radial hole with said second radial hole.

17. The apparatus according to claim 11, wherein said counter roller is coupled to said scoring blade roller so as to be rotationally driven by said scoring blade roller.

18. The apparatus according to claim 11, wherein said scoring blade roller further comprises a plurality of support rings, and wherein said suction shell and said at least one scoring blade are mounted on said support rings.

19. The apparatus according to claim 11, wherein said at least one scoring blade is arranged on a second angular portion of said circumference of said scoring blade roller, and wherein said second angular portion is displaced circumferentially from said first angular portion.

20. The apparatus according to claim 19, wherein said first angular portion and said second angular portion together make up a full 360° of said circumference of said scoring blade roller, there is no scoring blade arranged in said first angular portion, and there is no suction hole provided in said second angular portion.

21. A method of using the apparatus according to claim 11, for forming a score line on said sheet goods blank, comprising the following steps: holding said leading edge margin portion of said sheet goods blank on said scoring blade roller and rotating said scoring blade roller to transport said blank by pulling said blank in a transport direction between said scoring blade roller and said counter roller to form said score line on said blank, and loosely guiding said body tail portion of said blank downstream of said score line relative to said transport direction without holding said body tail portion fixedly to said scoring blade roller so that said body tail portion remains freely movable on said scoring blade roller to allow compensating movement of said body tail portion while said score line is being formed.

22. The method according to claim 21, wherein said step of holding said leading edge margin portion comprises applying a vacuum suction to a front edge margin of said leading edge margin portion of said blank so as to hold and guide said blank onto said scoring blade roller so as to pull said blank in said transport direction.

23. The method according to claim 22, wherein said blank is a letter envelope blank having a body and a back flap portion, and wherein said front edge margin is an edge margin of said back flap portion.

24. The method according to claim 21, wherein said blank is a letter envelope blank having a body and a back flap portion, and wherein said step of holding said leading edge margin portion comprises holding, guiding and pulling an edge margin of said back flap portion.

25. The method according to claim 21, excluding the formation of a fold, a pleat or a loop in said blank.

26. The method according to claim 21, wherein said blank is a pre-cut individual piece of a flexible, non-stretchable material and is not a continuous web, and wherein said pulling of said blank and said forming of said score line do not comprise stretching said material.

27. The method according to claim 21, wherein said step of holding said leading edge margin portion of said blank comprises applying a vacuum suction to said blank only on a leading edge margin of said blank along a leading edge of said leading edge margin portion of said blank in said transport direction, and wherein said method does not comprise applying a pushing force to any part of said body tail portion.

28. The method according to claim 21, wherein said transporting of said blank is not carried out with said blank traveling along a flat plane between said scoring roller and said counter roller.

29. The method according to claim 21, wherein said transport direction comprises a curved arc path along a portion of an outer circumference of said scoring blade roller, and wherein said transporting of said blank comprises curving said blank along said curved arc path to lie flushly on said portion of said outer circumference of said scoring blade roller.

30. The method according to claim 29, wherein said portion of said outer circumference extends over an angle of at least 90° about a rotation axis of said scoring blade roller.

31. The method according to claim 29, wherein said portion of said outer circumference extends over an angle of at least 120° about a rotation axis of said scoring blade roller.

32. The method according to claim 29, wherein said portion of said outer circumference extends over an angle of more than 180° about a rotation axis of said scoring blade roller.

33. The method according to claim 21, wherein said rows of suction holes are organized as groups of suction holes, and wherein said step of holding said leading edge margin portion of said blank comprises applying suction to a single selected one of said groups of said suction holes and not applying suction to said groups of said suction holes other than said single selected one of said groups.

34. The method according to claim 33, wherein said applying of said suction to said single selected one of said groups of said suction holes comprises continuously applying said suction to said selected one of said groups during said rotating of said scoring blade roller through a rotational transport angle from a first rotational position at which said selected one of said groups of said suction holes first suction-engages said leading edge margin portion of said blank to a second rotational position at which said selected one of said groups of said suction holes releases said leading edge margin portion of said blank.

35. The method according to claim 34, wherein said rotational transport angle is at least 120°.

36. The method according to claim 34, wherein said rotational transport angle is at least 180°.

37. The method according to claim 33, wherein each said group is a respective one of said rows of said suction holes extending parallel to a rotation axis of said scoring blade roller, and wherein said single selected one of said groups is a single one of said rows.

38. The method according to claim 37, further comprising adjusting said scoring blade roller to form a score line on a different blank having a different format size, wherein said adjusting comprises selecting a different one of said rows of said suction holes and applying said suction to said different one of said rows of said suction holes.

39. The method according to claim 33, wherein said applying of said suction to said selected one of said groups of said suction holes comprises applying said suction at a circumferential position on said scoring blade roller that is circumferentially spaced from said scoring blade by at least 30°.

40. An apparatus for forming a score line on a sheet goods blank, comprising:

a scoring roller having at least one suction opening and at least one scoring blade;

a counter roller cooperating with said scoring roller;

means for rotating said scoring roller and said counter roller and forming a nip therebetween;

means for taking up and holding a forward edge margin of a sheet goods blank onto said scoring roller at a first rotational position by applying suction to said forward edge margin through said at least one suction opening of said scoring roller, without holding a body portion and a trailing edge portion of said sheet goods blank downstream of said forward edge margin;

means for transporting said sheet goods blank by continuing said rotating and said holding and thereby pulling said sheet goods blank along with said rotating of said scoring roller while curving said body portion and said trailing edge portion of said sheet goods blank to lie against a portion of a circumference of said scoring roller;

means including said at least one scoring blade for forming a score line on at least one of said body portion and said trailing edge portion by pressing said sheet goods blank between said scoring blade and said counter roller while carrying out said transporting to pull said sheet goods blank through said nip between said scoring roller and said counter roller; and means for discontinuing said applying of said suction and thereby releasing said holding of said forward edge margin at a second rotational position of said scoring roller that is rotationally displaced from said first rotational position by at least 120°.

41. An apparatus for forming a score line on a sheet goods blank having a forward portion and a tail portion, said apparatus comprising:

a scoring roller including a scoring blade;

a counter roller arranged adjacent to said scoring roller to cooperate with said scoring blade;

means for rotating said scoring roller;

means for holding said forward portion of said sheet goods blank on said scoring roller to transport said blank by pulling said blank by said forward portion in a transport direction between said scoring roller and said counter roller so that said scoring blade forms a score line on said blank; and means for loosely guiding said tail portion of said blank following downstream of said score line relative to said transport direction without holding said tail portion fixedly to said scoring roller so that said tail portion remains freely movable on said scoring roller to allow compensating movement of said tail portion while said score line is being formed.

* * * * *